US005788420A

United States Patent [19]

Scales

[11] Patent Number: 5,788,420

[45] Date of Patent: Aug. 4, 1998

[54] CONNECTOR FOR ENGAGING SOIL-REINFORCING GRID AND EARTH RETAINING WALL

[76] Inventor: John Scales, 6347 Rosecommon Dr., Norcross, Ga. 30092

[21] Appl. No.: 594,844

[22] Filed: Jan. 31, 1996

Related U.S. Application Data

[62] Division of Ser. No. 325,621, Oct. 18, 1994, Pat. No. 5,511,910, and a continuation of Ser. No. 145,401, Oct. 29, 1993, Pat. No. 5,417,523, and a continuation-in-part of Ser. No. 12,031, Aug. 18, 1993, Pat. No. Des. 350,611.

[51] Int. Cl.[6] ..... E02D 5/00; E02D 29/00

[52] U.S. Cl. ..... 405/262; 52/576; 405/284; 405/286

[58] Field of Search ..... 52/576; 405/284, 405/285, 286, 262, 258

[56] References Cited

U.S. PATENT DOCUMENTS

| | | | |
|---|---|---|---|
| 2,144,630 | 1/1939 | Kotrbaty | 52/576 X |
| 2,902,854 | 9/1959 | Greene | 52/576 X |
| 4,324,508 | 4/1982 | Hilfiker et al. | 405/284 |
| 4,490,075 | 12/1984 | Risi et al. | 405/273 |
| 4,597,237 | 7/1986 | Celli | 52/576 X |
| 4,661,023 | 4/1987 | Hilfiker | 405/262 |
| 4,824,293 | 4/1989 | Brown et al. | 405/284 |
| 5,028,172 | 7/1991 | Wilson et al. | 405/286 |
| 5,131,791 | 7/1992 | Kitziller | 405/286 |
| 5,386,675 | 2/1995 | Baur et al. | 52/576 X |

*Primary Examiner*—Dennis L. Taylor

*Attorney, Agent, or Firm*—Kennedy, Davis & Kennedy

[57] ABSTRACT

An earth retaining wall having at least a pair of tiers of side-by-side blocks which define a receiving channel for a connector bar with spaced-apart keys that engage apertures in a lattice-like grid extending laterally from the tiers, the grid being covered by backfill for interlocking the backfill with the retaining wall, the keys distributing the load of the backfill evenly across the wall.

3 Claims, 4 Drawing Sheets

CONNECTOR FOR ENGAGING SOIL-REINFORCING GRID AND EARTH RETAINING WALL

This is a divisional of application Ser. No. 08/325,621 now U.S. Pat. No. 5,511,910 filed Oct. 18, 1994, a continuation of Ser. No. 08/145,401 filed Oct. 29, 1993 issued May 23, 1995 as U.S. Pat. No. 5,417,523, a continuation-in-part of Ser. No. 29/012,031 filed Aug. 18, 1993 issued Sep. 13, 1994 as U.S. Pat. No. Des. 350,611.

TECHNICAL FIELD

The present invention relates to earth retaining walls. More particularly, the invention relates to mechanically stabilized earth retaining walls having elongated key members that connect soil reinforcement grids to the walls and a method thereof.

BACKGROUND OF THE INVENTION

Many designs for earth retaining walls exist today. Wall designs must account for lateral earth and water pressures, the weight of the wall, temperature and shrinkage effects, and earthquake loads. One design type, known as mechanically stabilized earth retaining walls, employs either metallic or polymeric tensile reinforcements in the soil mass. The tensile reinforcements connect the soil mass to modular precast concrete members. The members create a visual vertical facing.

The polymeric tensile reinforcements typically used are elongated lattice-like structures referred to herein as grids. The grids have elongated ribs which connect to transversely aligned bars thereby forming elongated apertures between the ribs. The modular precast concrete members may be in the form of blocks or panels that stack on top of each other to create the vertical facing.

Various connection methods are used during construction of earth retaining walls to interlock the blocks or panels with the grids. One known retaining wall has blocks with bores extending inwardly within their top and bottom surfaces. The bores receive dowels or pins. After a first tier of blocks have been positioned laterally along the length of the wall, the dowels are inserted into the bores of the upper surfaces of the blocks. Edges of grids are placed on the tier so that each of the dowels extends through an aperture. This connects the wall to the grids. The grids extend laterally from the blocks. The dowels are spaced apart such that not every aperture in the grid receives a dowel. Typically, there are several open apertures between each dowel. When the second tier of blocks is positioned, the upwardly extending dowels fit within the bores of the bottom surfaces of the blocks. Once the earth is backfilled over the grids, the load of the earth is distributed at the dowel to the grid connection points. The strength of the grid-to-wall connection is generated by the friction between the block surfaces and the grid and by the linkage between the aggregate trapped in the wall and the apertures of the grid. The magnitude of these two contributing factors varies with workmanship of the wall, normal stresses applied by the weight of the wall above the connection, and by the quality and size of the aggregate.

In another known retaining wall, an upper surface of blocks includes projections and a lower surface of blocks includes cavities. The projections are wider than the apertures in the grids. Enlarged openings are formed by severing several ribs that define adjacent apertures. The projections of a first tier of blocks receive the enlarged openings of the grids. The cavities in the second tier of blocks then enclose the projections in the first tier.

The specifications of earth retaining walls are based upon the strength of the interlocking components and the load created by the backfill. Once the desired wall height and type of ground conditions are known, the number of grids and positioning of them is determined dependent upon the load capacity of the interlocking components. In walls of the type having a dowel construction, the load capacity is a function of the strength of the portion of the concrete block surrounding the dowels. In walls of the type having projections, the load capacity is a function of the strength of the concrete block portion forming the projections.

In both instances, the load of the backfill is concentrated at the point of interlock between either the dowels or projections and the grid apertures. In neither case is the full strength of the grid apertures being utilized since several apertures are void of connecting dowels or the apertures have been destroyed by severing the ribs between apertures. Thus, these walls are limited in the carrying load on the connections to the grid. Transferring the load over more transversely aligned bars facilitates larger loads. Also, the load would be absorbed by the grids with less concentrated stress on the grids and on the portion of the block forming the connection.

Thus, there exists a need for a mechanically stabilized earth retaining wall having a connection between soil reinforcement elements and individual wall units which utilizes the entire design strength of the grids, which evenly distributes the load of the backfill across the length of the grids sufficient to meet the design strength of the grids, and which minimizes the stress around the area of the wall unit that absorbs the load. Accordingly, it is to the provision of such an improved mechanically stabilized earth retaining walls that the present invention is directed.

SUMMARY OF THE INVENTION

The present invention meets the need for an improved earth retaining wall. Generally described, the present invention comprises at least two stacked tiers of blocks placed side by side. The lower tier of blocks has at least an upper channel in a top surface. The upper tier of blocks has at least a lower channel in a bottom surface. The upper channel in a lower tier aligns with the lower channel in an adjacent upper tier to define a receiving conduit between adjacent tiers. A connector bar is positioned within the receiving conduit for connecting the blocks to a lattice-like grid that extends laterally from the wall. The connector bar has a base and a series of spaced-apart keys that extend vertically from a top surface of the base. The connector bar is positioned in the upper channel and the grid is attached to the keys. The grid extends outwardly of the wall and the earth, rocks, or other backfill material then is placed to cover the grid. The connector bar connects the grid to the wall and the grid distributes the load of the backfill evenly across the wall.

DETAILED DESCRIPTION OF THE INVENTION

Figure 1:
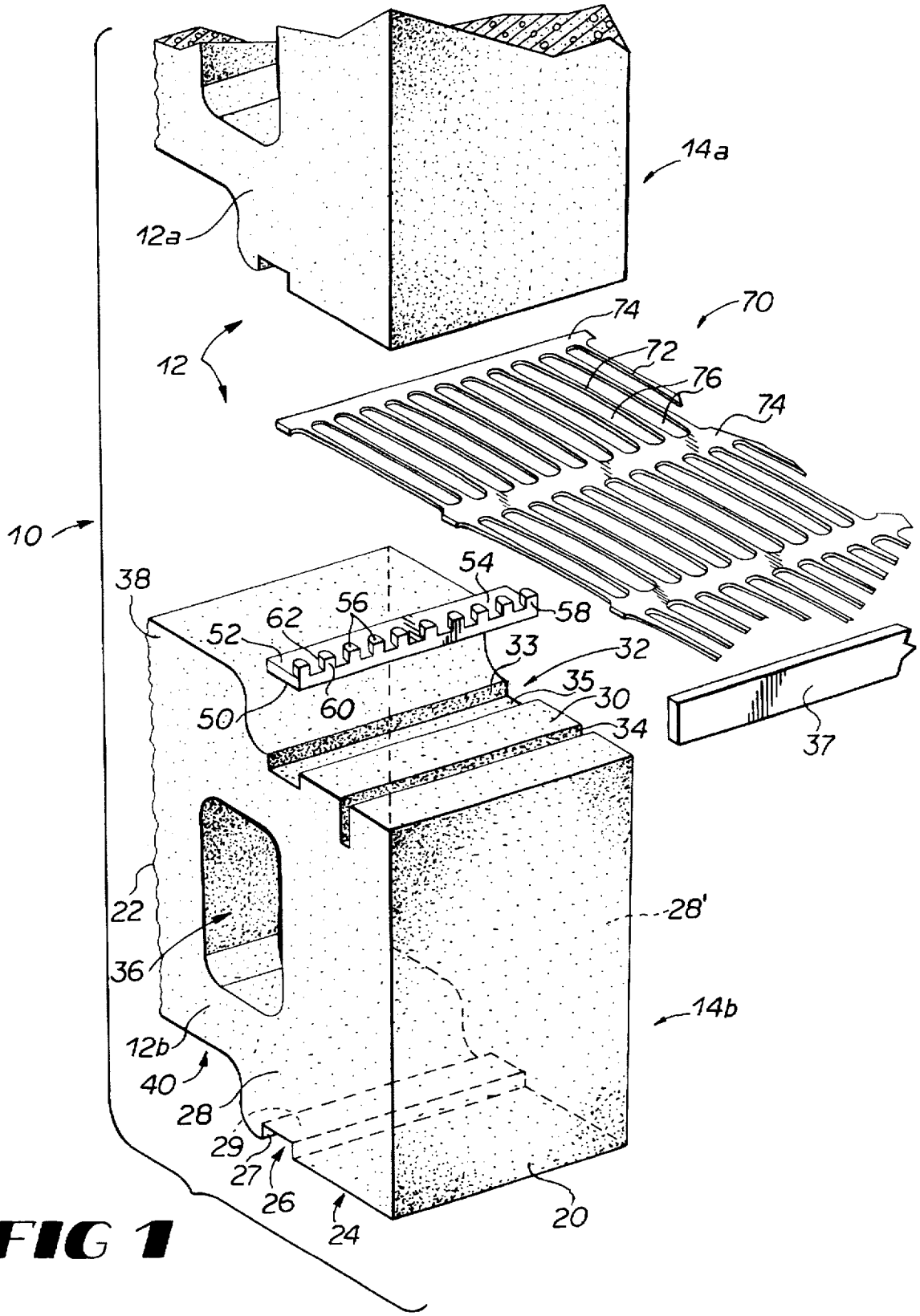
FIG. 1 is an exploded perspective view of the preferred embodiment of the present invention.
Figure 3:
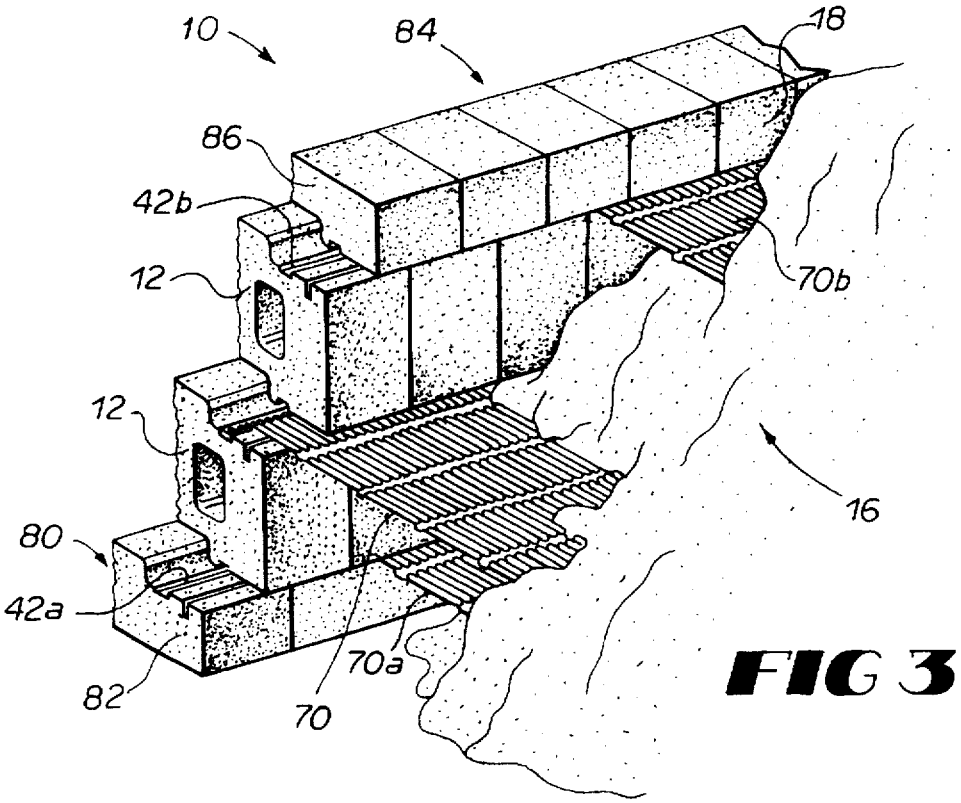
FIG. 3 is a perspective view of an earth retaining wall constructed using the preferred embodiment of the invention.

Referring now in more detail to the drawings, in which like numerals indicate like parts throughout the several views, FIG. 1 is an exploded perspective view of a portion of a retaining wall 10 according to the present invention. The wall 10 comprises at least two tiers 12 of blocks 14 placed in a stack. As best illustrated in FIG. 3, the blocks 14 in each tier 12 are placed side-by-side to form the elongated retaining wall 10 having dirt, rocks, or other backfill material 16 on an interior side 18. With continued reference to FIG. 1, each block 14 has an interior face 20 and an exposed exterior face 22. The exposed face 22 can include an ornamental facing for the wall 10. The block 14 has a bottom surface 24 with a lower channel 26 extending from a first side 28 to an opposing second side 28'. The lower channel 26 is defined by a pair of side walls 27 and a top 29. The block 14 has a top surface 30 with an upper channel 32 extending from the first side 28 to the opposing second side 28'. The upper channel 32 is defined by side walls 33 and a bottom 35. The lower channel 26 and the upper channel 32 are transversely aligned, for a purpose discussed below.

The illustrated embodiment of the block 14 further includes a lateral alignment slot 34. The slot 34 is a narrow channel extending inwardly into the block 14 from the top surface 30. The slot 34 receives an elongated rod 37 during installation of a tier 12, for aligning adjacent blocks as discussed below.

The blocks 14 preferably are formed of pre-cast concrete. The illustrated embodiment includes an interior opening 36, which reduces the material costs and the weight of the block without sacrificing the required strength of the block for compression and stress forces. An alternate embodiment (not illustrated) defines a vertically disposed interior passage through the block, for receiving aggregate during construction of the wall. Additional embodiments (not illustrated) are blocks of the type having only an upper channel or blocks of the type having only a lower channel.

The illustrated embodiment of the block 14 includes a raised portion 38 between the exterior face 22 and the upper channel 32. A notch 40 that conforms in shape to the raised portion 38 is formed in the lower surface between the exterior face 22 and the lower channel 26. The notch 40 of the block **14*a* in an upper tier 12*a* matingly nests with the raised portion 38 in the block 14*b* in an adjacent lower tier 12*b*. When two blocks are thus stacked together, the upper channel 32 in the lower block 14*b* cooperates with the lower channel 26 in the upper block 14*a* to define a receiving channel 42 that holds a connector bar 50 shown exploded from the lower block 14*b***.

The connector bar 50 is shown exploded from the top surface 30 of the lower block **14*b*. The connector bar 50 is received between the upper channel 32 of the lower block 14*b* and the lower channel 26 of the upper block 14*a* that define the receiving channel 42 in the wall 10. The connector bar 50 comprises an elongated member having a base 52 with an upper planar surface 54 and a series of spaced-apart keys 56, for a purpose discussed below. The keys 56 extend upwardly from the base 52 along a first side 58. In the illustrated embodiment, the keys 56 each have a planar face 60 and an arcuate face 62. The planar face 60 contacts the inner side walls 27 and 33 of the respective upper and lower channels 32 and 26. The connector bar 50** is preferably formed of a rigid polymeric material with high tensile strength, such as nylon or fiberglass reinforced polyester.

A sheet-like grid 70 is illustrated exploded from the blocks 14. The grid 70 is a planar structure formed by a network of spaced-apart members 72 which connect to spaced-apart transverse ribs 74. The connection of the members 72 and the transverse ribs 74 form apertures 76 in the lattice-like grid 70. The apertures 76 define an open space between the adjacent members 72 and ribs 74. The apertures 76 receive dirt, rocks, or other backfill materials for interlocking the grid 70 to that material which is retained by the wall 10, as discussed below. In a preferred embodiment, the grid 70 is made of a synthetic material, such as plastic.

Figure 2:
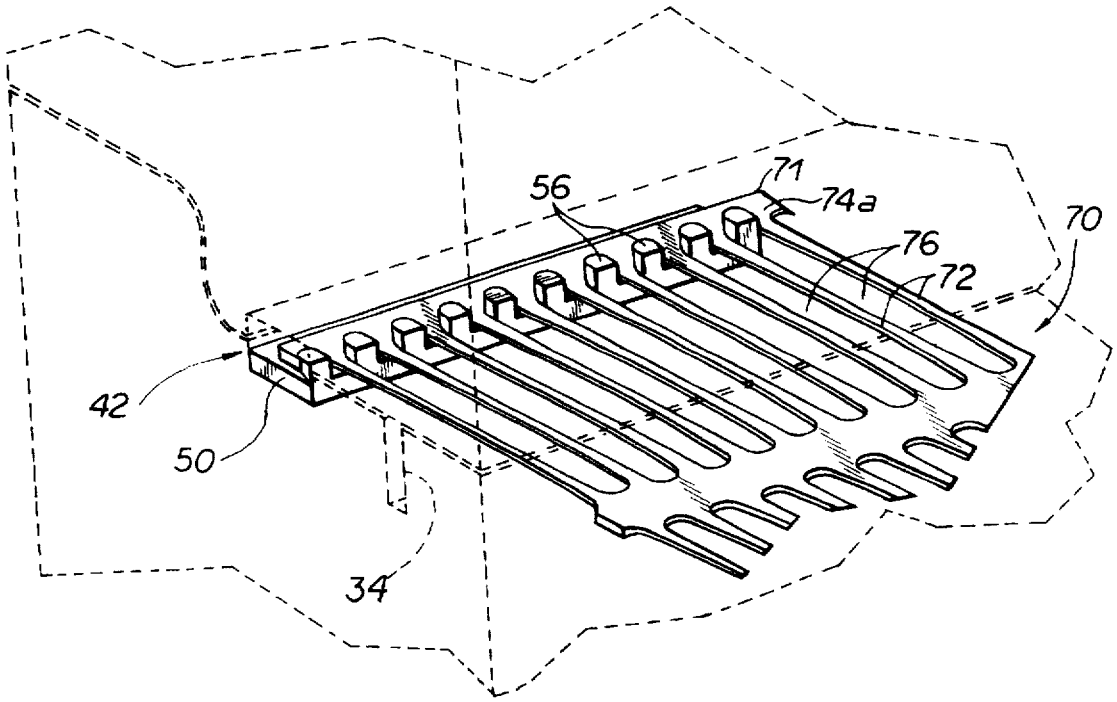
FIG. 2 is a detailed perspective view of the preferred embodiment of the present invention.

FIG. 2 illustrates the coupling together of the connector bar 50 and the grid 70 within the receiving channel 42. The upper block **14*a* and the lower block 14*b* in the wall 10 are illustrated in phantom. One edge 71 of the grid 70 extends over the connector bar 50, and the keys 56 thereby extend upwardly through the apertures 76. The transverse rib 74*a* on the edge 71 of the grid 70 contacts the upper surface 54 of the base 52. The members 72 extend laterally from the stacked blocks 14 through a gap defined between the top surface 30 and the bottom surface 24 of the adjacent stacked blocks. The grid 70 thereby extends laterally from the interior face 20 of the blocks 14**.

As illustrated in FIG. 3, the wall 10 comprises tiers 12 of the blocks 14 from which grids 70 extend laterally. Dirt, rocks, or other backfill material 16 is placed around the grids 70, as discussed below. The illustrated wall 10 includes an initial tier or course 80 of base blocks 82. These base blocks 82 comprise the structural features of the upper half of the block 14. Accordingly, the base blocks 82 include the top surface 30 and the upper channel 32 as discussed above for the blocks 14. In this manner, the half-blocks 82 nest with the blocks 14 for forming one of the receiving channels 42 in the wall 10. In the illustrated embodiment, the course of base blocks 82 cooperate with the adjacent tier of blocks 14 to define the channel **42*a* for the lowermost grid 70*a* in the wall 10. Similarly, the upper end of the wall 10 is finished with a tier or course 84 of cap blocks 86. The cap blocks 86 are half-blocks comprising the structural features of the bottom surface 24 and the lower channel 26. In this manner, the cap blocks 86 nest with the upper surface of the blocks 14 for forming one of the receiving channels 42 in the wall 10. In the illustrated embodiment, the course 84 of cap blocks 86 define the channel 42*b* for the uppermost grid 70*b* in the wall 10**.

Figure 4:
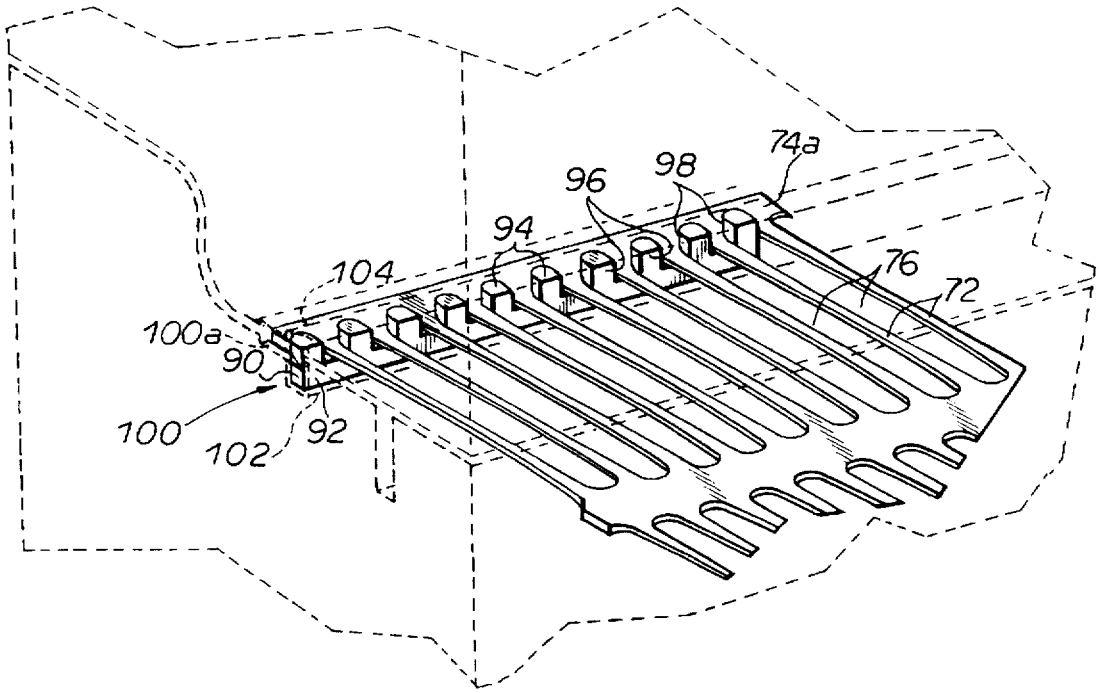
FIG. 4 is detailed perspective view of a second preferred embodiment of the present invention.

FIG. 4 illustrates a connector bar 90 as an alternate embodiment of the connector bar 50 shown in FIG. 2. The connector bar 90 includes a narrow base 92 from which keys 94 extend upwardly. The keys 94 have a planar face 96 and an arcuate face 98. The connector bar 90 mounts in a narrow receiving channel 100 that is defined by the mating upper and lower channels in the adjacent blocks 14 (illustrated in phantom). The receiving channel 100 is sufficiently wide to accommodate receiving the transverse rib 72 at the edge of the grid 70. The block 14 include an upper channel 102 in a top surface and a lower channel 104 in a bottom surface. The upper channel 102 in the blocks of a lower tier 12 align with the lower channels 104 in the adjacent higher tier, after the grid 70 is positioned. The grid 70 extends over the connector bar 50 and the keys 56 thereby extend upwardly through the apertures 76. The transverse rib 74*a* on the edge of the grid 70 contacts the upper surface of the block 14. The members 72 extend laterally from the stacked blocks 14 through a gap defined between the top surface 34 and the bottom surface 24 of the stacked blocks. The grid 70 thereby extends laterally from the interior face 20 of the blocks 14.

Figure 5:
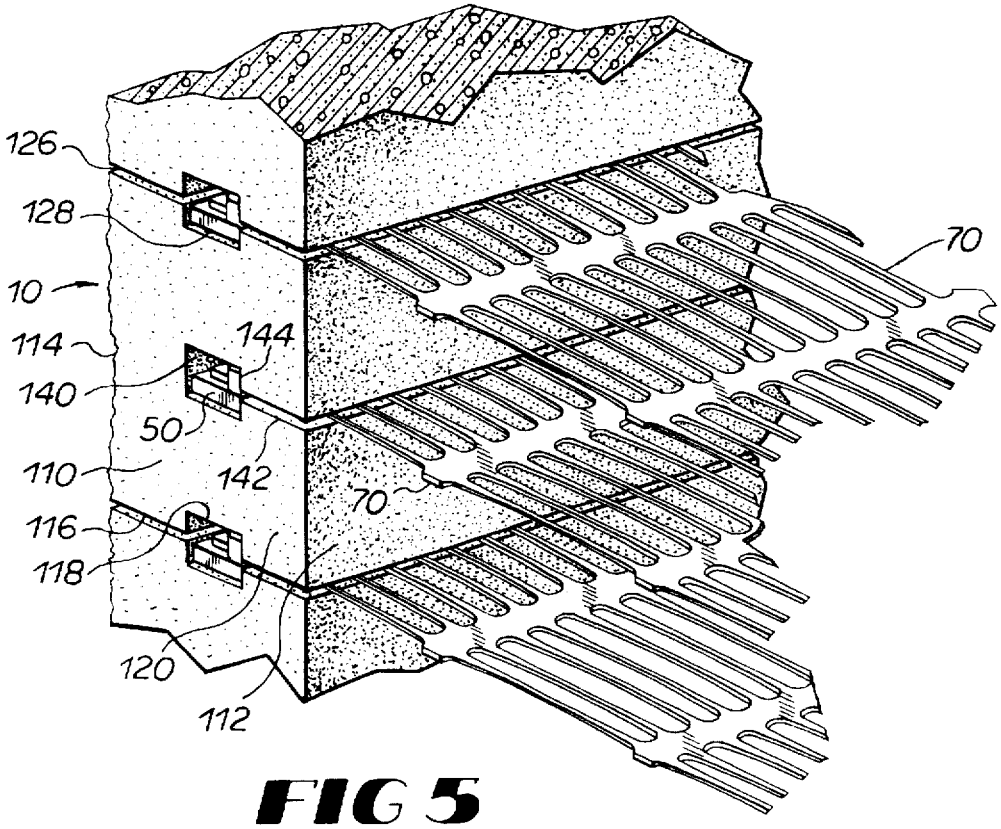
FIG. 5 is a perspective view of a third preferred embodiment of the present invention.

FIG. 5 illustrates an alternate embodiment of the retaining wall 10 formed with elongated panels 110 instead of the blocks 14. The panels 110 have lengths and widths substantially greater than their thickness. The panels 110 include an interior face 112 and an exposed exterior face 114. The exposed face 114 can include an ornamental facing for the wall 10. The panel 110 has a bottom surface 116 with a lower channel 118 extending from a first side 120 to an opposing second side. The lower channel 118 is defined by a pair of side walls and a top. The panel 110 also includes a top surface 126 with an upper channel 128 extending from the first side 120 to the opposing second side. The upper channel 128 is defined by a pair of side walls and a bottom. The lower channel 118 and the upper channel 128 are transversely aligned, for a purpose discussed below.

The panel 110 further includes at least one intermediate receiving channel 140 forming a bore through the panel from the first side 120 to the opposing second side. The channel 140 is sized for slidably receiving a connector bar 50. A slot 142 extends laterally from a side 144 of the channel 140 to the interior face 112. The slot 142 provides an opening in the panel 110 for slidably receiving one of the grids 70, as discussed below. The channel 140 and the slot 142 are formed during casting of the block, or in an alternate embodiment discussed below, comprise an insert molded into the block during casting.

Figure 6:
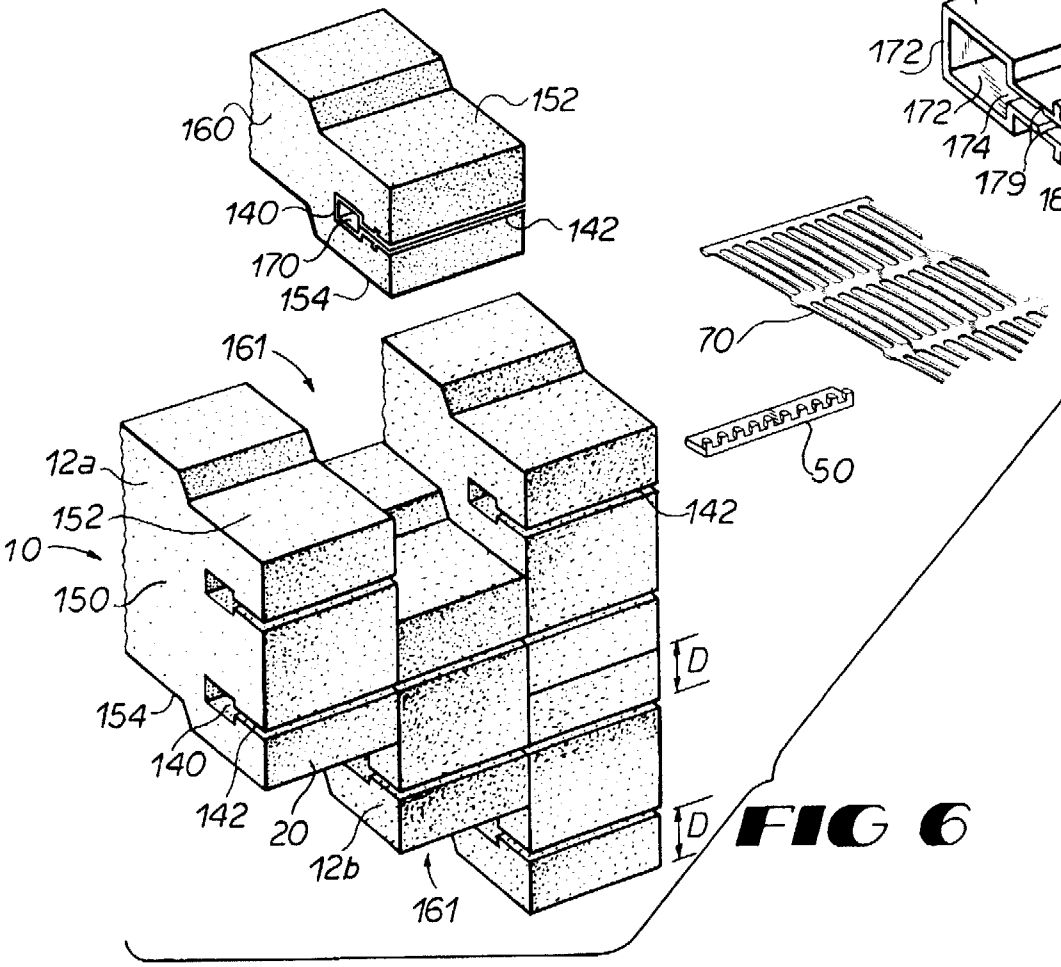
FIG. 6 is a perspective exploded view of an alternate embodiment of the present invention.

FIG. 6 illustrates a perspective view of a portion of a wall 10 having blocks 150 of an alternate embodiment. The base blocks 82 are not illustrated. The blocks 150 are vertically staggered with the blocks in one tier 12*b* alternately spaced between the blocks in the adjacent tier 12*a*. The blocks 150 include a top surface 152 and a bottom surface 154. The blocks 150 have at least one intermediate channel 140 forming a bore through the block for receiving at least one connector bar 50. The slot 142 extends from the inner wall of the channel 140 to the interior face 20 of the block, for slidably receiving the grid 70, as discussed below. In the illustrated embodiment, the blocks 150 have a pair of intermediate channels 140. Each channel 140 in this embodiment is equally spaced D from the adjacent respective top and bottom surface 152 and 154. This facilitates aligning the channels and the blocks during assembly of the wall 10 as discussed below.

The grid 70 and the connector bar 50 are illustrated as exploded to one side of the portion of the wall 10. A half-block 160 is shown exploded from the wall 10. The half-block 160 fills one of the gaps 161 between the staggered upper and lower tiers 12 and 12*b* at both the upper extent and the base of the wall 10. The half-block 160 comprises the top and bottom surfaces 152 and 154 of the block 150. The half-block 160 includes one intermediate channel 140 with its slot 142 for receiving the grid 70 as discussed below. The intermediate channel 140 aligns coaxially with the adjacent blocks 150. The half-blocks 160 are used to fill the gaps between blocks 150 in the lower tier and upper tier of the wall 10.

Figure 7:
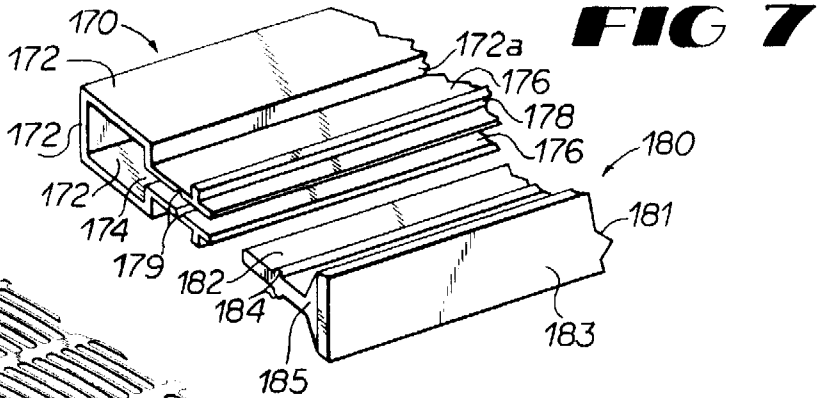
FIG. 7 is a perspective view of a channel-molding apparatus for use in embodiments of the present invention.
Figure 8:
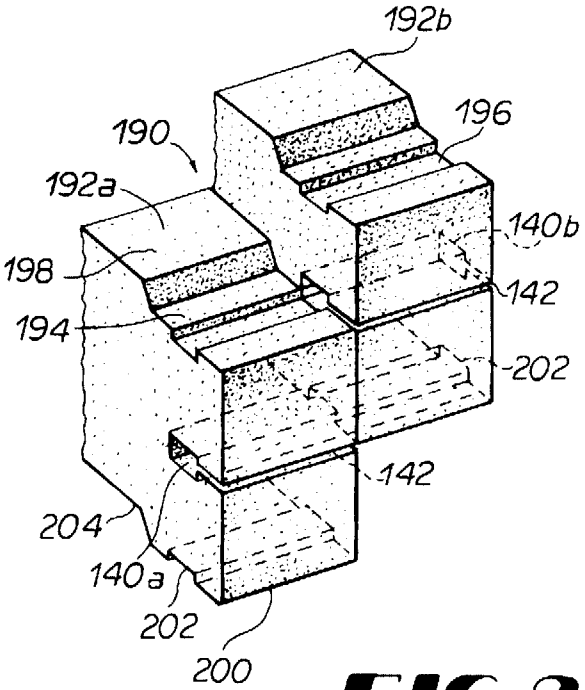
FIG. 8 is a perspective view of another alternate embodiment of the present invention.

The intermediate channels 140 in FIGS. 5, 6, and 8 are preferably extruded tubular members 170 illustrated in FIG. 7. The tubular member 170 inserts into a mold for the block prior to casting. For convenience of illustration, the tubular member 170 is shown in the block 160 of FIG. 6. The tubular member 170 has four walls 172 that define the elongated intermediate receiving channel 140. An inner wall 172*a* includes a longitudinally extending slit opening 174 or slot. A pair of flanges 176 extend laterally from the wall 172*a* adjacent the opening 174. The flanges are spaced-apart a distance for slidably receiving the grid 70. A projection 178 extends outwardly from each flange 176. The projection 178 extends along the length of member 170 for a purpose discussed below. The inner surface of each of the flanges 176 includes a shallow dished groove 179 for a purpose discussed below. The grooves 179 are transversely aligned and are spaced apart from the wall 172*a*.

Exploded from the member 170 is an insertable cap 180. The cap 180 includes a head 181 which in the illustrated embodiment is fan-shaped in cross-sectional view, having a wide outer side 183. An arm 182 extends laterally from a narrow side 185 of the cap 180. The arm 182 includes a pair of tabs 184 in the upper and lower surfaces of the arm. The tabs 184 extend along the length of the arm 182.

In use, the arm 182 of the cap 180 inserts between the flanges 176 of the member 170. The tabs 184 engage the grooves 179 in the flanges 176 to secure the cap 180 to the member 170. The wide outside edge of the cap 180 provides a support to hold the member in a mold during casting of the blocks used in the wall 10, as discussed above. After casting the block, the cap 180 is removed by detaching the tabs 184 from the grooves 179 and removing the arm 182 from between the flanges 176. The projections 178 provide an anchor for the channel 140 in the cast block.

FIG. 8 illustrates an integral block 190 as an alternate embodiment which comprises two bodies 192*a* and 192*b*. Each body 192 includes a top surface 194 having an upper channel 196 and a raised portion 198. Each body 192 also includes a bottom surface 200 with a lower channel 202 and a notched portion 204. The intermediate channel 140 is disposed between the top and bottom surfaces. The intermediate channel 140*a* in the body 192*a* coaxially aligns with the lower channel 202 in the body 192*b*. The intermediate channel 140*b* in the body 192*b* coaxially aligns with the upper channel 196 in the body 192*a*.

The retaining wall 10 of the present invention is constructed as discussed below with reference to FIGS. 1 and 3. A site for the wall 10 is selected and if desired, a ditch (not illustrated) can be cut for receiving the blocks of the wall. The lowermost tier 80 of base blocks 82 are placed side-by-side in the ditch or on the ground surface where the wall 10 is to be constructed. A tier 12 of blocks 14 are then placed on the base blocks 82. The blocks 14 can be offset so the side of the blocks in the tier are staggered with respect to the sides of the blocks in the adjacent tier. The elongated rod 37 is inserted into the lateral alignment slot 34 of the blocks 14. The rod 37 preferably extends over at least two adjacent blocks 82 to align the blocks.

One of the grids 70 can then be connected to the blocks 14 at this tier. The grids 70 are selectively placed to meet the design requirements for the wall, and each tier does not necessarily require a grid. If no grid is installed, the next tier 12 of blocks 14 are placed on the lower tier.

If the grid 70 is placed on the tier, at least one of the connector bars 50 is placed in the upper channel 32 of the blocks 82. The connector bar 50 is positioned within the channel 32 with the planar face 60 closest to the interior face 20 of the blocks and abutting against the inner wall 33. The channel 32 preferably has a width that exceeds the width of the base 52 of the connector bar 50 for slidably positioning the connector bar in the channel. The height of the base is preferably about the same as the depth of the channel 32 in the top surface 30.

After a series of connector bars 50 are positioned in the channels 32 of the blocks 82, the grid 70 is pulled into position with the edge 71 of the grid overlapping the top surface and the connector bars 50. The keys 56 extend upwardly through the apertures 76 in the grid 70. The grid 70 extends laterally from the blocks 82. The rounded inner end of each aperture contacts the respective arcuate face 62 of the key 56 extending through the aperture. The connector bar 50 preferably has a length less than the width of the grid 70, which typically deforms as it is manufactured. The spacing between apertures 76 may therefore be unequal. In a preferred embodiment, the connector bar 50 has nine keys 56. Variations in aperture spacing is accommodated by skipping one or two apertures between adjacent connector bars 50 in the channel 32.

The grid 70 is then locked into the wall 10 by placing the next tier 12 of blocks 14 in the wall. The upper tier 12a aligns with the lower tier **12*b* by the mating connection between the raised portion 38 in the upper surface of the blocks in the lower tier 12*b* and the notched portion 40 in the lower surface of the adjacent upper tier 12*a* in the wall. When two blocks of adjacent tiers are thus stacked together, the upper channel 32 in the lower block cooperates with the lower channel 26 in the upper block to form the receiving channel 42 for the connector bar 50. The planar face 60 of the connector bar 50 abuts against the inner wall 33**.

Dirt, rocks, or other backfill material 16 is then placed around and over the laterally extending grid 70. The dirt and rocks engage the apertures 76 and interlock the backfill material to the grid 70. The load of the backfill material 16 is thereby placed on the grids 70. The connector bars 50 transfer the load to the wall 10.

The foregoing process continues by repeatedly positioning upper tiers of the blocks 14 on an adjacent lower tier for assembling the wall 10 to the desired height. At selected tiers, the grids 70 are attached to connector bars 50 held in the channels 32, as discussed above. The grid 70 is engaged to the keys 56. An adjacent tier of blocks 14 are positioned. The grid 70 is covered with dirt, rocks, and other backfill 16. Finally, the cap blocks 86 are installed to finish the wall 10 at the desired height. The improved retaining wall of the present invention does not require installing one of the grids 70 and connector bars 50 between each pair of adjacent tiers 12 or along the entire length of the wall 10.

In the alternate embodiment illustrated in FIG. 5, panels 110 are used to construct the wall 10. The panels are elongated blocks, preferably preformed concrete, that include the intermediate receiving channel 140. The upper channel 128 receives the connector bars 50 as discussed above with respect to the blocks 14. The grid 70 is attached to connector bar 50 by engaging the keys 56 in the apertures 76. The lower channel 118 in one of the panels 110 on the adjacent higher tier covers the connector bar 50 and forms the receiving channel 42. This locks the connector bar 50 and the grid 70 to the wall 10. Dirt or other backfill then covers the grid 70 extending laterally from the wall 10. The backfill covers up to about the depth of the intermediate channel 140.

The intermediate receiving channel 140 of the panel 110 then slidingly receives at least one of the connector bars 50 which is attached to a grid 70 by inserting the keys 56 into the apertures 76. The joined connector bar 50 and the grid 70 then are slidingly pulled into position. The connector bar 50 travels in the receiving channel 140 and the grid travels in the slot 142. Once positioned, the grid 70 is covered with dirt, rocks, and other backfill 16 for securing the backfill to the grid 70.

In a wall in which the panels 110 are placed in a vertically staggered relationship, the intermediate receiving channel 140 and upper channel 32 are juxtaposed with coaxial alignment. Both the intermediate receiving channel 140 and the upper channel 32 slidingly receive at least one of the connector bars 50 which is attached to the grid 70. The joined connector bar 50 and the grid 70 are slidingly pulled into position. The connector bar 50 travels in the receiving channel 140 and the upper channel 32. The grid 70 travels in the slot 142 and over the top surface 34 between the inner side wall 33 to the interior face 20. The lower channel 118 in at least one of the panels 110 on the adjacent higher tier covers the connector bars 50 and forms the receiving channel 42. This locks the connection bars 50 and the grid 70 to the wall 10. Once positioned, the grid 70 is covered with the backfill 16 for securing the backfill to the wall 10. The backfill 16 covers up to about the depth for the next higher grid 70.

As illustrated in FIG. 6, the blocks 150 can be arranged in a vertically staggered relationship with the sides 28 offset with respect to adjacent tiers of blocks. The channels 140 in a block in one tier **12*a* align with channels in separate vertically staggered blocks in the adjacent tier 12*b*. The connector bar 50 attaches to the grid 70 as discussed above. The connector bar and the grid then slidingly insert into the channels 140** of the aligned blocks. Backfill is placed on the grid as discussed above to interlock the grid and the backfill.

The integral block 190 illustrated in FIG. 8 can be used to construct staggered walls as discussed above. The blocks 190 stack together in tiers. The lower channel 200 in the body **192*a* aligns with the upper channel 196 in the body 192*a* in the adjacent lower tier (not illustrated). The channel 200 coaxially aligns with the intermediate channel 140*b* in the body 192*b* in the adjacent lower tier. The notch 204 couples with the raised portion 198 in the adjacent block 190. The grid 70 is then placed on the selected tier before the wall is built higher. At least one connector bar 50 is attached to the grid 70 and slidingly inserted into the channel 140. Another connector bar 50 can be placed in the upper channel 196 for attachment to the apertures 76 of the grid 70. The next tier of blocks 190 are placed in the wall, and the backfill 16 is poured over the grid. Construction of the wall 10 continues with tiers and grids 70 being connected together until the design height of the wall is reached. Cap blocks, such as those blocks 86 illustrated in FIG. 3, complete the upper end of the wall 10**.

Although not illustrated, the blocks discussed above can include bores that extend inwardly from the upper and lower surfaces. The bores in the blocks in a tier receive a pin. The protruding pin engages the lower bore of the block in the adjacent tier for alignment of the blocks. In an alternate embodiment (not illustrated), mating wedge-shaped projections extend outwardly from the sides 28 of the blocks to provide increased interlocking of the blocks and increased wall strength.

It thus is seen that an improved earth retaining wall is now provided with a connector bar that evenly distributes the load of the backfill material across the wall. While this invention has been described in detail with particular reference to the preferred embodiments thereof, it should be understood that many modifications, additions and deletions may be made thereto without departure from the spirit and scope of the invention as set forth in the following claims.

What is claimed is:

1. A tubular insert for a cementitious block used with a plurality of said blocks in forming an earth-retaining wall with a laterally extending grid for securing the wall to earth backfill, comprising:

an elongated tube having a longitudinally extending slot in a side wall;

a pair of spaced-apart flanges extending laterally from the side wall adjacent the slot; and a groove on an inner surface of each flange, the groove extending parallel to the slot, for removably receiving a plug that holds the flanges spaced apart during casting of the cementitious block, whereby the tube, being cast into a cementitious block, forms a receiving channel within the block with distal edges of the flanges extending to an exterior face of the side of the block for receiving edge portions of a sheet-like grid extending laterally of the block, the edge of said grid slidingly received in the tube.

2. The tubular insert as recited in claim 1, wherein the plug comprises:

an elongated cap having an arm extending laterally from a side;

a pair of tabs extending outwardly from the upper and the lower surfaces of the arm, the tabs positioned in the arm for mating engagement with a respective groove in the flange, whereby the arm, being inserted between the flanges, blocks the slot in the side wall of the tube and the cap supports the elongated tube in the mold, during casting of the block.

3. The tubular insert as recited in claim 2, wherein the cap is T-shaped in cross-section.

* * * * *